United States Patent [19]

Rosenberg et al.

[11] 4,024,607

[45] May 24, 1977

[54] CLASP

[75] Inventors: Melvin Rosenberg, North Woodmere; Sheldon Brickner, Brooklyn, both of N.Y.

[73] Assignees: Melvin Rosenberg; Morris Schwartz, both of North Woodmere, N.Y.

[22] Filed: Mar. 24, 1976

[21] Appl. No.: 669,808

Related U.S. Application Data

[63] Continuation-in-part of Ser. No. 569,259, April 18, 1975, Pat. No. 3,967,351.

[52] U.S. Cl. ..... 24/201 HE; 24/230 SC

[51] Int. Cl.[2] ..... A44B 17/00

[58] Field of Search ..... 24/75, 201 HE, 230 F, 24/230 G, 230 SC, 230 CF; 339/253 R, 256 SP

[56] References Cited

UNITED STATES PATENTS

| | | | |
|---|---|---|---|
| 474,264 | 5/1892 | Pitcher | 24/230 CF |
| 627,300 | 6/1899 | Habicht | 24/230 CF |
| 1,151,333 | 8/1915 | Baruch | 24/230 SL |
| 1,385,117 | 7/1921 | Dinhofer | 24/230 CF |
| 1,499,428 | 7/1924 | Wagner | 24/230 SC |
| 1,516,462 | 11/1924 | Schvarcz | 24/75 |
| 2,046,734 | 7/1936 | Freysinger | 24/230 SL |
| 2,368,543 | 1/1945 | Hattenrath | 24/230 CF |
| 2,747,170 | 5/1956 | Batcheller | 339/256 SP |
| 3,469,770 | 9/1969 | Zeller | 24/201 HE |

FOREIGN PATENTS OR APPLICATIONS

| | | | |
|---|---|---|---|
| 344,013 | 10/1904 | France | 24/230 CF |
| 188,834 | 9/1907 | Germany | 24/230 SL |
| 1,128,175 | 1/1957 | France | 24/230 SC |

*Primary Examiner*—Bernard A. Gelak
*Attorney, Agent, or Firm*—McAulay, Fields, Fisher & Goldstein

[57] ABSTRACT

A clasp for an article of jewelry or the like of the type having a latch member engageable with a keeper member for fastening the clasp. The latch member has a resiliently depressible hook portion disposed for movement from a normally extended position to a flexed position. The keeper member comprises a housing having an open end through which the hook portion of the latch member may be inserted or withdrawn when the hook portion is in its flexed position. The housing also includes an apertured wall located to receive the hook portion for engaging the latch member within the housing and permitting the hook portion to move to its extended position for fastening the clasp. The hook portion extends beyond the aperture in the housing wall when the latch member is engaged within the housing, and terminates in an end portion overlying an edge portion of the housing wall forming the periphery of said aperture when the latch member is moved in the direction of withdrawal from the housing. The overlying relation of the hook end portion to the housing wall prevents the hook portion from moving to the flexed position to inadvertently unfasten the clasp. The design of the hook portion is such to reduce the likelihood of it being sheared off when the clasp members are engaged and under tension. At such time as it is desired to unfasten the clasp, the latch member is moved in the direction of insertion in said housing to align said hook portion with said aperture and the hook portion is then moved to its flexed position to permit the latch member to be withdrawn through the open end of the housing.

8 Claims, 14 Drawing Figures

CLASP

CROSS REFERENCE TO RELATED APPLICATIONS

This application is a continuation-in-part of application Ser. No. 569,259 filed Apr. 18, 1975, now U.S. Pat. No. 3,967,351 issued July 6, 1976.

BACKGROUND OF THE INVENTION

1. Field of the Invention

This invention relates generally to a clasp for detachably holding two articles together, and more particularly, to a clasp for an article of jewelry or the like of the type having a latch member engageable with a keeper member for fastening the clasp.

2. Description of the Prior Art

Heretofore, many forms of clasps have been proposed wherein a latch member is formed having a resilient tongue portion disposed to interengage with an accommodating recess or opening formed in a wall surface of a keeper member or housing. The uses of such clasps have become quite common in connection with garments, jewelry or key chains, or whenever it is desired to detachably hold two articles together. Illustrative examples of such clasps are shown and described in U.S. Pat. No. 1,371,210 (King) and U.S. Pat. No. 3,251,110 (Hedu) wherein the resilient tongue portion of each latch member projects outwardly from the upper surface of said member. Additional examples of such clasps are noted in U.S. Pat. No. 2,266,074 (Rauer) and U.S. Pat. No. 2,908,953 (Anderson) wherein the resilient tongue portion of each clasp member projects outwardly from the side edges of said member.

Each of the above constructions share in a common disadvantage in that it is often a relatively simple matter to inadvertently depress the tongue portion and thereby permit the latch member to disengage from the housing without any knowledge on the part of the person wearing the clasp. It will be appreciated that the unknowing disengagement of the clasp often results in the loss of the article of jewelry connected to the separable members of the clasp.

It has also been proposed to provide a fastener which incorporates a protective guard to prevent the tongue portion from accidentally becoming disengaged from the keeper member. An illustrative example of such a fastener is shown and described in U.S. Pat. No. 941,542 (Simpson) which provides a leaf spring normally biased in contact with the tongue portion to prevent the accidental disengagement of the fastener members. However, the structure and operation of this kind of fastener are not suitable for smaller and thinner sized clasps of the kind usually employed in articles of jewelry.

Furthermore, in the construction of articles of clothing, such as the waistband construction disclosed in U.S. Pat. No. 1,151,333 (Baruch) there is provided interengaging members which are disposed in overlying relation. However, the structure and operation of this kind of fastener are also not suitable for smaller and thinner sized clasps of the kind usually employed in articles of jewelry, and further require a special key to disassociate the engaged members.

Accordingly, an object of the present invention is to provide an improved jewelry clasp which substantially reduces the likelihood of the latch member becoming inadvertently or accidentally disengaged from the keeper member or housing.

Another object and feature of the present invention is to provide a clasp for articles of jewelry or the like which is relatively simple in construction and economical to manufacture.

A further object, feature and advantage of the present invention is to provide a clasp having improved locking or retaining means for securely fastening the separable members of the clasp.

SUMMARY OF THE INVENTION

The clasp of the present invention represents an improvement over the clasp disclosed in applicants' copending application. Ser. No. 569,259, filed Apr. 18, 1975, now U.S. Pat. No. 3,967,351 issued July 6, 1976. The clasp of said earlier application is of the type having a latch member engageable with a keeper member for fastening the clasp. The latch member has a resiliently depressible hook portion disposed for movement from a normally extended position to a flexed position. The keeper member comprises a housing having an open end through which the hook portion of the latch member may be inserted or withdrawn when the hook portion is in its flexed position. The housing also includes an apertured wall located to receive the hook portion upon insertion thereof for engaging the latch member within the housing and permitting the hook portion to move to its extended position for fastening the clasp.

The hook portion is sized to extend beyond the aperture in the housing wall when the latch member is engaged within the housing. The hook portion also terminates in an end portion overlying an edge portion of the housing wall forming the periphery of said aperture when the latch member is moved in the direction of withdrawal from the housing. The overlying relation of the hook end portion to the housing wall when the clasp members are engaged and under tension serves to prevent the hook portion from moving to its flexed position to inadvertently or accidentally unfasten the clasp.

At such time as it is desired to unfasten the clasp, the hook portion is aligned with the aperture in the housing wall and then moved to its flexed position to disengage the latch member from the housing and permit the flexed hook portion to be withdrawn through the open end of the housing.

The improvement herein provides for the hook portion to be formed having first and second arcuately shaped sections extending rearwardly from the forward insertable end of said latch member. The first section of said hook portion represents the hook end integrally connected to the latch member whereas the second section represents the hook end disposed in overlying relation to the housing wall when the clasp members are engaged and under tension. The first section is formed having a transverse dimension greater than the corresponding dimension of the second to define a shoulder. The curvature of said first section, in combination with said shoulder, serves to reduce the likelihood of said hook portion being sheared off when the clasp members are engaged and under tension.

The hook portion is stamped out of the material constituting the latch plate to define an opening therein. In order to prevent the hook portion from becoming stuck in said opening when the hook portion is depressed to its flexed position, the first section of the hook portion may be formed having a recess which serves to longitudinally displace the second section relative to said opening, whereby the distant end of the second section is disposed in overlying relation to an edge portion of the latch plate forming the periphery of said opening. Alternatively, the surface portions of the plate adjacent said opening may be staked to narrow said opening to thereby block the passage of said distant end through said opening when the hook portion is moved to its flexed position.

Additional features and advantages of the present invention will become more apparent from a consideration of the following detailed description when taken in conjunction with the accompanying drawings.

DESCRIPTION OF THE PREFERRED EMBODIMENT

Figure 1:
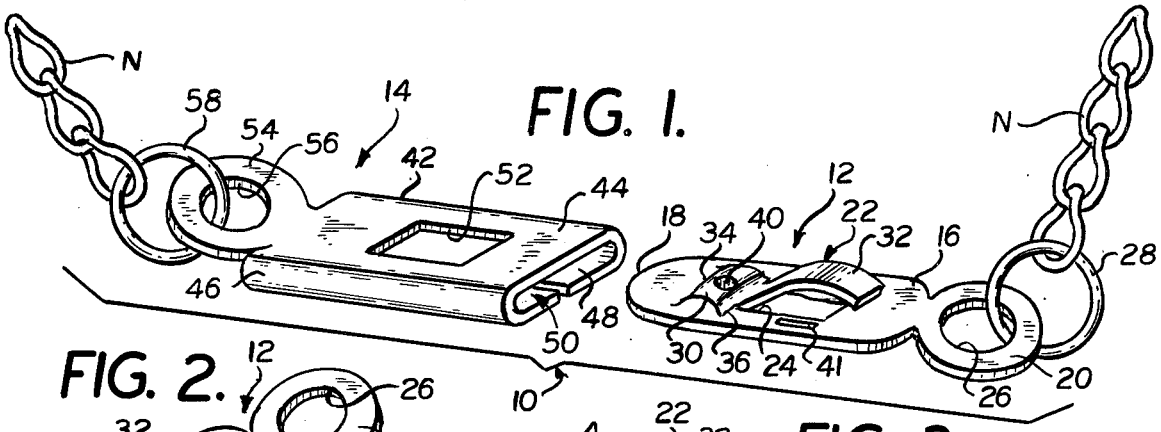
FIG. 1 is a perspective view of a clasp constructed in accordance with the present invention, and illustrating the separable members of the clasp prior to interengagement thereof.
Figure 2:
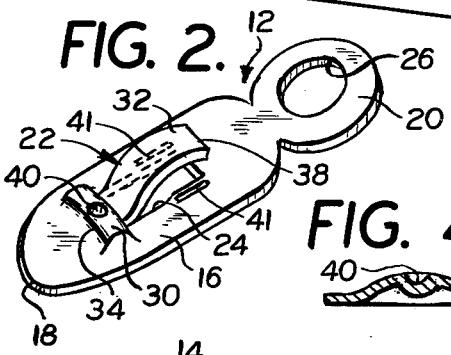
FIG. 2 is another perspective view of the latch member of the clasp illustrated in FIG. 2.
Figure 3:
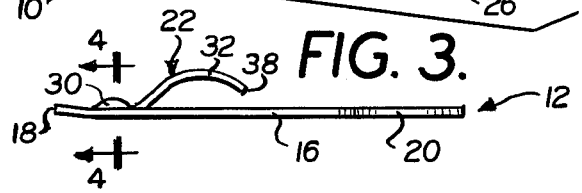
FIG. 3 is a side elevational view of the latch member illustrated in FIG. 2.

Referring to the drawings, and more particularly to FIGS. 1–5, numeral 10 represents an improved clasp constructed in accordance with the present invention. Clasp 10 is illustrated as detachably holding together the opposite ends of a necklace N; however, it will be appreciated that the clasp can also be used with other articles of jewelry, such as a bracelet, or whenever it is desired to detachably hold two articles together.

Clasp 10 is of the type having a latch member 12 engageable with a keeper member 14 for fastening the clasp. Latch member 12 represents a thin latch plate 16 manufactured by a stamping operation and constructed of a metal having a thickness in the range between 0.004 inches (0.010 cm.) and 0.006 inches (0.015 cm.). The length of latch plate 16 extends between 0.30 inches (0.76 cm.) and 0.50 inches (1.27 cm.), and its width is in the range between 0.09 inches (0.23 cm.) and 0.15 inches (0.38 cm). It is to be noted that the above dimensions are illustrative of the preferred construction and are not to be deemed limitations on the invention. It is clear, however, that latch plate 16 is relatively thin and of lightweight construction.

Figure 6:
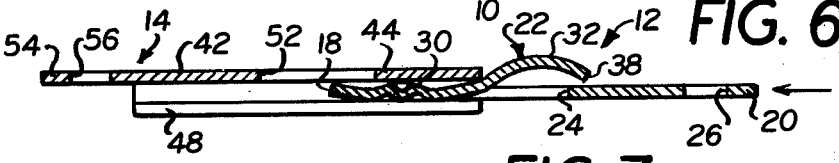
FIGS. 6 and 7 are views similar to FIG. 5 illustrating the resiliently depressible hook portion of the latch member successively moved to its flexed position for insertion of said latch member within the housing.
Figure 7:
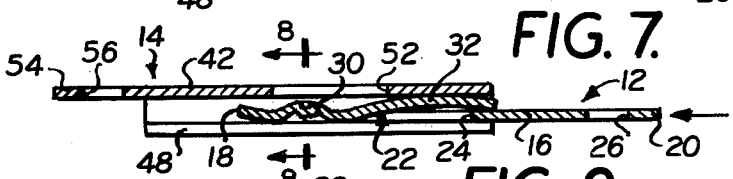
Figure 8:
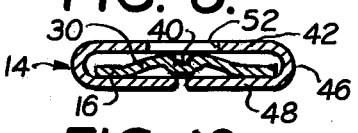
FIG. 8 is a sectional view taken through line 8—8 of FIG. 7.
Figure 13:
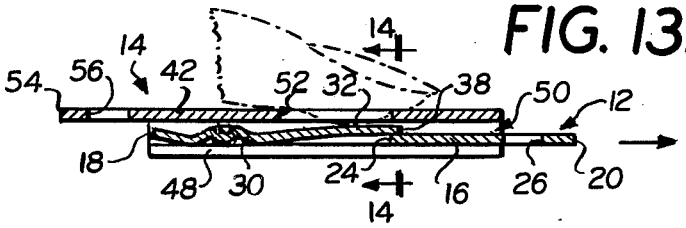
FIG. 13 is a view similar to FIG. 9 illustrating the position of the members for unfastening of the clasp wherein the hook portion is moved to its flexed position to disengage the latch member from the housing.
Figure 14:
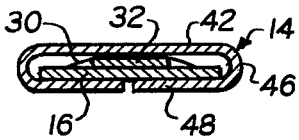
FIG. 14 is a sectional view taken through line 14—14 of FIG. 13.

Latch plate 16 is formed having a forwardly insertable end portion 18 and a rearwardly end portion 20. A resiliently depressible hook portion, represented generally by numeral 22, projects outwardly from the upper surface of plate 16 and is located intermediate the end portions. Hook portion 22 extends rearwardly of forward end portion 18 to form and open-ended passage between hook portion 22 and plate 16. Hook portion 22 is stamped out of the material constituting the latch plate 16 thereby defining an opening 24 in said plate. Hook portion 22 is disposed for movement from a normally extended position, as indicated in FIGS. 1–3, 5, 9 and 11, to a flexed position in the direction toward plate 16, as indicated in FIGS. 6, 7 and 13. The rearward end portion 20 of plate 16 is formed with a through opening 26 for receiving a link 28 or other suitable fastener for connecting latch plate 16 to one end of necklace N in conventional manner.

In accordance with the invention herein, hook portion 22 is formed having first and second arcuately shaped sections 30 and 32, respectively, each extending rearwardly of forward end portion 18. The first section 30 represents the end of hook portion 22 which is integrally connected to latch plate 16 along line 34. The second section 32 represents the end of hook portion 22 which is adapted to engage with keeper member 14 in the manner hereinafter described.

Figure 4:
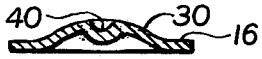
FIG. 4 is a sectional view taken through line 4—4 of FIG. 3.

First section 30 is formed having a transverse dimension greater than the corresponding dimension of second section 32 to define a shoulder 36. In some instances, first section 30 may be further formed having an arcuately shaped surface extending transversely of hook portion 22, as illustrated in FIG. 4. In other words, first section 30 may be formed having a compound curvature extending both longitudinally and transversely of hook portion 22. The curvature of first section 30, in combination with shoulder 36, reduces the likelihood of hook portion 22 being sheared off when the clasp members are engaged and under tension.

In certain instances prior to the invention herein, when hook portion 22 was moved to its flexed position, the distant end 38 of said hook portion was received within plate opening 24 and had a tendency to sometimes become struck therein. In accordance with the present invention, the first section 30 of hook portion 22 may be formed having a recess or detent 40 which serves to longitudinally displace the second section 32 relative to plate opening 24. This serves to locate the distant end 38 of hook portion 22 in overlying relation to an edge portion of latch plate 16 forming the periphery of plate opening 24, as viewed in FIGS. 6, 7 and 13, when hook portion 22 is moved to its flexed position. Since the distant end 38 of hook portion 22 is no longer capable of being received within plate opening 24, the aforesaid problem has been eliminated. Alternatively, the surface portions of plate 14 adjacent opening 24 may be staked, as represented by numeral 41 in FIGS. 1 and 2, which serve to narrow said opening to thereby block the passage of free end 38 through said opening 24 when hook portion 22 is moved to its flexed position.

The arcuate shape of second section 32 serves to locate the distant end 38 of hook portion 22 in a downwardly extending position in the direction toward latch plate 16. This configuration reduces the likelihood of injury to the wearer due to the presence of any sharp or unfinished edges of distant end 38, and also facilitates the unfastening of the clasp in the manner hereinafter described.

Keeper member 14 represents a thin walled housing 42 manufactured by a stamping and bending operation, and constructed of a metal having a thickness in the range beween 0.004 inches (0.010 cm.) and 0.006 inches (0.015 cm.). The overall length of housing 32 is approximately 0.30 inches (0.76 cm), its width is approximately 0.11 inches (0.28 cm.) and its height or depth is approximately 0.05 inches (0.13 cm.). Here, again, the above dimensions are illustrative and are not to be deemed limitations on the invention.

The material used to manufacture the housing 42 is bent to form a top wall 44, a pair of opposed side walls 46, 46 and a split bottom wall 48 to define an open front end, represented generally by numeral 50, for receiving the latch member 12 in the manner hereinafter described. Housing top wall 44 is formed having an elongated aperture or opening 52 having suitable dimensions and located to receive the hook portion 22 for engaging the latch plate 16 within housing 42. The rear end of top wall 44 terminates in an annular ring-like portion 54 projecting rearwardly in the direction opposite to front end opening 50. Ring portion 54 defines a through opening 56 for receiving a link 58 or other suitable fastener for connecting keeper member 14 to the other end of the necklace N in conventional manner.

Figure 5:
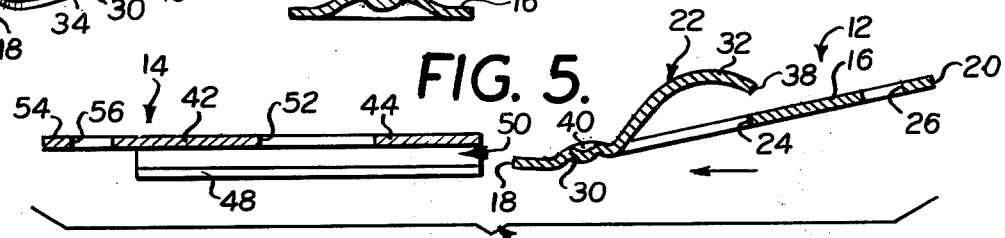
FIG. 5 is a side elevational view, with parts in section, illustrating the separable members of the clasp prior to interengagement thereof.
Figure 9:
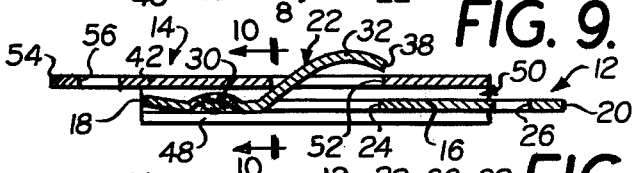
FIG. 9 is a view similar to FIG. 7 illustrating the latch member engaged within the housing and the hook portion moved to its extended position for fastening the clasp.
Figure 10:
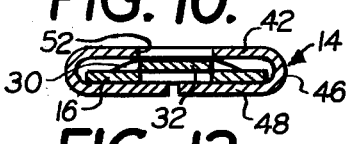
FIG. 10 is a sectional view taken through line 10—10 of FIG. 9.

In fastening the clasp 10, the forward end portion 18 of latch plate 16 is moved in the direction of the arrow shown in FIG. 5 and inserted into the open front end 50 of the housing 42. The open end of housing 42 has a smaller height dimension than the corresponding dimension of latch plate 16 when hook portion 22 is in its extended position. Thus, insertion of latch plate 16 within housing 42 causes the normally extended hook portion 22 to be moved toward its flexed position as shown in FIGS. 6 and 7. The continued insertion of plate 16 within housing 42 permits the flexed hook portion 22 to be received within the aperture top wall 44 of the housing whereupon the hook portion 22 is then free to move back to its normally extended position, as shown in FIG. 9, for fastening the clasp. The configuration of hook portion 22 and the dimensions of top wall aperture 52 are such that the second section 32 of hook portion 22 extends beyond top wall aperture 52 when latch plate 16 is engaged within housing 42. Thus, when latch member 12 is now moved in the direction of withdrawal from keeper member 14, latch plate 16 is prevented from being completely withdrawn from housing 42 by means of the extended hook portion 22 which projects beyond the top wall aperture 52.

Figure 11:
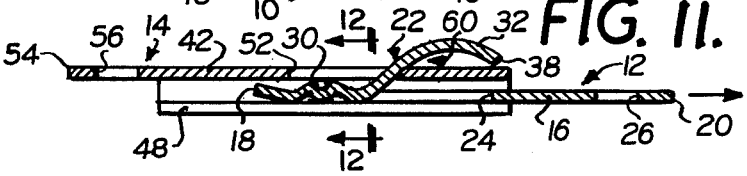
FIG. 11 is a view similar to FIG. 9 illustrating the hook end portion overlying a surface portion of the housing wall when the latch member is moved in the direction of withdrawal from the housing and thereby preventing movement of said hook portion to its flexed position.
Figure 12:
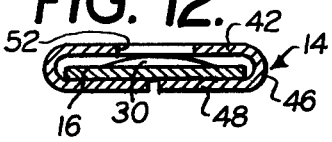
FIG. 12 is a sectional view taken through line 12—12 of FIG. 11.

Retaining means, represented generally by numeral 60 in FIG. 11, are provided to prevent the inadvertent or accidental movement of hook portion 22 to its flexed position when latch plate 16 is engaged within housing 42. In this regard, it has been found that when the clasp 10 is fastened and the necklace N or other article is placed in position for normal use, there is a force exerted on the clasp urging latch member 12 and keeper member 14 in opposite directions. In other words, latch plate 16 and housing 42 may be considered as being under tension when the clasp 10 is fastened as illustrated in FIG. 11. It is to be noted that when the clasp members are under tension, second section 32 of hook portion 22 terminates in a downwardly and rearwardly projecting end 38 overlying an edge portion of housing top wall 44 forming the periphery of the aperture 52 to prevent movement of the hook portion 22 to its flexed position. In other words, when the clasp members are fastened and under tension, the edge portion of the housing wall defining the aperature is received in the open-ended passage formed between the hook portion 22 and the latch plate 16. The overlying relation of the hook end portion 38 to the housing top wall when the clasp members are engaged and under tension serves to prevent the hook portion 22 from moving to its flexed position to inadvertently or accidentally unfasten the clasp.

Referring to FIG. 11, it is noted that the edge portion of the housing wall defining aperture 52 engages the second section 32 of hook portion 22 adjacent the juncture of said first and second sections 30, 32, respectively. Thus, when the clasp members are fastened and under tension, a compression force is exerted on hook portion 22 in the region adjacent said juncture. However, due to the curvature of first section 30, and the different transverse dimensions of said first and second sections, the force is transmitted to shoulder 36 and to the first section 30 in a direction which reduces the likelihood of hook portion 22 being sheared off when the clasp members are engaged and under tension.

At such time as it is desired to unfasten the clasp 10, the latch plate 16 is again moved forwardly within the housing 42, as shown in FIG. 13, until the hook portion 22 is aligned with the aperture 52 in the housing top wall 44. The hook portion 22 may then be digitally depressed and moved to its flexed position to permit the latch plate 16 to be withdrawn through the open front end 50 of the housing.

It is apparent that the length of the housing beyond the apertured wall is greater than the length of the latch plate received in said housing when the hook end portion overlies the edge portion of said housing wall defining said aperture to permit additional movement of the latch plate relative to the housing in the direction of insertion. Such relative movement permits the clasp to be unfastened in the manner heretofore described.

Furthermore, in view of the curvature of the second section 32 of hook portion 22, it is not necessary to digitally depress hook portion 22 to its fully flexed position for unfastening the clasp. In this regard, so long as the distant end 38 of hook portion 22 is depressed through the opening 52 in housing top wall 44, the second section 32 will thereafter cam against the forward edge of said housing wall opening 52 and cause hook portion 22 to be displaced to its flexed position upon movement of latch plate 16 in the direction of withdrawal from housing 42.

There is thus provided a clasp having improved locking or retaining means for securely fastening the separable members of the clasp to prevent the accidental disengagement thereof, and which clasps are relatively simple in construction and economical to manufacture.

While a preferred embodiment of the invention has been shown and described in detail, it will be readily understood and appreciated that numerous omissions, changes and additions may be made without departing from the scope of the present invention.

We claim:

1. In a clasp for an article of jewelry having a latch member engageable with a keeper member, said latch member having a base plate with a forwardly insertable end portion and further having a resiliently depressible hook portion projecting outwardly from said plate, said hook portion extending rearwardly of said insertable end portion and being disposed for movement between an extended position and a flexed position in the direction toward said plate, said keeper member having walls defining an opening through which the latch member may be inserted when said hook portion is in its flexed position, and retaining means on said keeper member engageable with said hook portion to permit said hook portion to move to its extended position for fastening said clasp, said retaining means comprising an edge portion of at least one of said walls, said edge portion being spaced from said opening, and said engaged hook portion overlying said edge portion when said hook portion is moved in the direction of withdrawal from said keeper member to thereby prevent movement of said engaged hook portion to its flexed position, said keeper member being sized to permit additional movement of said latch member in the direction of insertion for unfastening said clasp and disengaging said hook portion from said retaining means to permit said hook portion to be moved to its flexed position for withdrawing said latch member from said keeper member, wherein the improvement comprises:

a. said hook portion having a first section connected to said plate and a second section connected to said first section, said first and second sections each projecting outwardly from said plate;

b. said first section having a transverse dimension greater than the corresponding dimension of said second section to define a shoulder at the juncture of said sections, the deflection of said second section about said juncture when said hook portion is moved between its extended and flexed positions being substantially greater than the deflection of said first section relative to said plate when said hook portion is moved between said positions; and c. said second section terminating in a hook end projecting in the direction toward said plate;

d. wherein the wall edge portion of said keeper member engages the second section of said hook portion adjacent the juncture of said first and second sections when said hook portion is engaged with said keeper member and is located in overlying relation to said wall edge portion.

2. A clasp for an article of jewelry or the like comprising:

a. a latch member engageable with a keeper member;

b. said latch member comprising a thin latch plate having a forwardly insertable end portion and a rearwardly end portion adapted to be connected to said article, said latch member further comprising a resiliently depressible hook portion projecting outwardly from said plate; said hook portion extending rearwardly of said insertable end portion and being disposed for movement from a normally extended position to a flexed position in the direction toward said plate;

c. said hook portion having a first section connected to said latch plate and a second section connected to said first section; said first and second sections each projecting outwardly from said latch plate; said first section having a transverse dimension greater than the corresponding dimension of said second section to define a shoulder at the juncture of said sections; the deflection of said second section about said juncture when said hook portion is moved between its extended and flexed positions being substantially greater than the deflection of said first section relative to said plate when said hook portion is moved between said positions; and said second section terminating in a hook end projecting in the direction toward plate;

d. said keeper member comprising a thin walled housing having a portion adapted to be connected to said article, and an open end portion adapted to receive the insertable end portion of said latch plate; said open end portion having a dimensional extent smaller than the corresponding dimensional extent of said latch plate when said hook portion is in its extended position and through which open end the hook portion of said plate may be inserted or withdrawn when said hook portion is in its flexed position; said housing further having an apertured wall located to receive said hook portion upon insertion thereof for engaging said latch plate within said housing and permitting said hook portion to move to its extended position for fastening said clasp;

e. said hook portion being sized to extend beyond the aperture in said housing wall when said latch plate is engaged within said housing;

f. said hook end overlying an edge portion of the housing wall defining said aperture when said engaged latch plate is moved in the direction of withdrawal from said housing to prevent movement of said hook portion to its flexed position;

g. said housing wall edge portion engaging the second section of said hook portion adjacent the juncture of said first and second hook sections when said hook end is in overlying relation to said edge portion;

h. the length of said housing being sized to permit additional movement of said latch plate relative to said housing in the direction of insertion when said hook end is in overlying relation to said housing wall edge portion;

whereby said clasp is unfastened by moving said latch plate in the direction of insertion in said housing to align said hook portion with said aperture and then moving said hook portion to its flexed position to permit said latch plate to be withdrawn through the open end portion of said housing.

3. The improved clasp as recited in claim 2, wherein the first section of said hook portion has an arcuately shaped surface extending longitudinally of said hook portion.

4. The improved clasp as recited in claim 3, wherein said hook portion is stamped out of said latch plate to define an opening therein; the surface of said first section having a recess to longitudinally displace said second section relative to said plate opening to locate the hook end of said second section in overlying relation to an edge portion of said latch plate forming the periphery of said plate opening when said hook portion is moved to its flexed position.

5. The improved clasp as recited in claim 3, wherein said hook portion is stamped out of said latch plate to define an opening therein; a surface of said latch plate adjacent said opening being staked to narrow said opening to block the passage of the hook end of said second through said opening when said hook portion is moved to its flexed position.

6. The improved clasp as recited in claim 3, wherein the second section of said hook portion has an arcuately shaped surface extending longitudinally of said hook portion.

7. The improved clasp as recited in claim 2, wherein said hook portion is located between the forward and rearward end portions of said latch plate.

8. The improved clasp as recited in claim 2, wherein the sole means for moving said hook portion from its extended position to its flexed position for unfastening said clasp is by the application of pressure directly on said hook portion when said hook portion is in alignment with the aperture in said housing wall.

* * * * *